United States Patent [19]

Lund

[11] 4,274,334

[45] Jun. 23, 1981

[54] MACHINE FOR CHANGING RAILS

[75] Inventor: Raymond R. Lund, West Columbia, S.C.

[73] Assignee: Canron Corporation, West Columbia, S.C.

[21] Appl. No.: 951,133

[22] Filed: Oct. 13, 1978

[51] Int. Cl.[3] ..... E01B 29/05

[52] U.S. Cl. ..... 104/2; 104/5

[58] Field of Search ..... 104/1 R, 2, 5, 7 R, 104/16, 17 R; 144/3 H, 133 B

[56] References Cited

U.S. PATENT DOCUMENTS

| | | | |
|---|---|---|---|
| 1,798,783 | 3/1931 | Buettner et al. | 144/133 B |
| 1,941,930 | 1/1934 | Collet et al. | 104/5 |
| 3,286,648 | 11/1966 | Brosnan | 104/2 |
| 3,298,105 | 1/1967 | Stewart et al. | 104/7 R |
| 3,318,259 | 5/1967 | Oville | 104/2 |
| 3,722,423 | 3/1973 | Plasser et al. | 104/17 R |
| 3,949,678 | 4/1976 | Theurer | 104/7 R |

FOREIGN PATENT DOCUMENTS

| | | | |
|---|---|---|---|
| 1225827 | 3/1971 | United Kingdom | 104/2 |

*Primary Examiner*—John J. Love

*Assistant Examiner*—Ross Weaver

*Attorney, Agent, or Firm*—Wenderoth, Lind & Ponack

[57] ABSTRACT

A machine for removing old rails and replacing them with new rails is constituted by an adzing station where the surfaces of the old ties are adzed after removing the old rails and tie plates. The adzing station has two adzers spaced laterally on either side of the center of the machine for adzing laterally spaced locations at which new tie plates and rails have to be laid. The adzers are mounted, respectively, on two frames which can move together laterally with respect to a third frame in response to a center line follower so that the adzers are always located at the correct lateral position even on curved track. The third frame is attached to the main frame of the machine and it can be pivoted selectively about two spaced lateral locations adjacent to where the adzers are mounted in response to control signals from an inclinometer mounted on the pivotal frame and control signals from a superelevation device measuring the superelevation of the track. Thus the adzers are maintained substantially perpendicular to the ties for all conditions of cross-level including superelevation on curves.

35 Claims, 6 Drawing Figures

MACHINE FOR CHANGING RAILS

BACKGROUND OF THE INVENTION

This invention relates to a machine for adzing old ties on track from which the tie plates and rails have been removed, and also to a rail changing machine incorporating such an adzing arrangement.

Devices for changing rails which have existed to date have been hampered in operation by the great number of auxiliary operations which have to be performed by different workcrews using different machines.

It is an object of the present invention to provide a rail changing machine which, in its preferred embodiment, is capable of replacing rails without any additional operations being necessary.

The present invention makes use of a novel adzer support which is pivotable with respect to the main frame of the machine and about a pivot point which coincides approximately with one laterally disposed adzer or about a pivot point which coincides approximately with the other laterally disposed adzer as selected. By this means the adzers may be maintained substantially perpendicular with respect to superelevated or banked ties which are provided at curves and, of course, the frame is pivotal in either direction to accommodate right or left curves.

As an additional feature the degree of tilting is measured automatically and fed back to a device for measuring the superelevation of the track, whereby the adzers are automatically maintained at the correct angle.

Preferably, the adzers are also mounted for conjoint lateral movement on the pivotal frame in response to signals from a centre line follower which follows a previously applied track centre line. This additional feature permits the adzer station to be accommodated on a long work beam on which are mounted other work stations because on curved track the adzers are simply moved laterally to the correct rail location.

DESCRIPTION OF THE PREFERRED EMBODIMENT

Figure 1A:
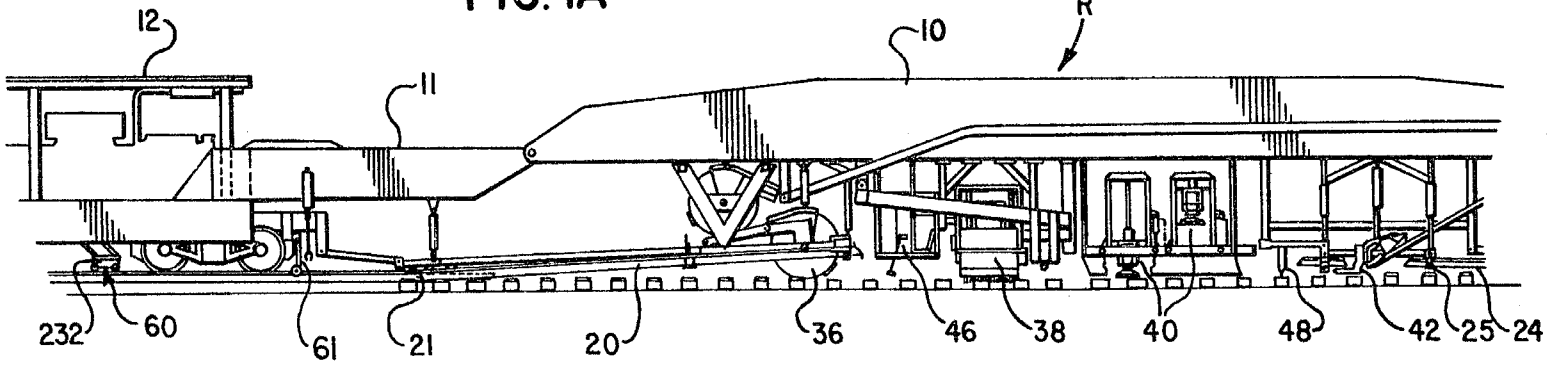
FIG. 1 A, B is a schematic side view of a rail changing machine incorporating novel tie plate pick up means, adzers and tie plate drop means.

The center beam or main frame 10 of a rail changing machine R is shown connected to the beam 11 of a leading powered car 12 and to the beam 13 of a trailing car 14. The old rails 20 of the old track are shown being picked up by rollers 21 of the old conventional rail removing means and these rails are then spread by spreaders (not shown) and deposited on the shoulders of the track in a known manner. New rails 24 have previously been deposited on the shoulders of the track adjacent the existing rails 20 and new rail rollers 25 of a new rail laying means controlled by an operator, pick up and lay the new rail, as is known.

Between the old rail moving means and the new rail moving means are positioned a series of track working instruments each mounted on a respective work frame. These instruments comprise, in turn, a magnetic pick-up means 36 for the tie plates left after lifting and spreading of the old rails, crib sweeping means 38 mounted in front of an adzer 40 and tie plate dropping means 42.

A hole plugging station 46 is provided between the tie plate pick-up 36 and the crib sweeper 38 and a creosoting station 48 is preferably provided after the adzer.

A lining device 50, line spiker 52, gauger 54 and gauge spiker 56 complete the work stations.

In operation, the tie plate pick-up means 36 picks up the old tie plates left after lifting and spreading of the old rails, it being understood that the spikes securing the old rails to the ties would have been removed as a preliminary step, as is known. As the machine advances, a human operator in the hole plugging station injects a polyurethane foam into the old spike holes. The cribber 38 then sweeps a path in front of the adzer 40 to remove ballast and other debris from the line of the adzer which proceeds to adze the ties at the tie plate locations at each rail to provide flat beds of increased size in the upper surface of the tie which are capable of receiving new or recycled tie plates of increased size.

The creosoter 48 then supplies creosote to the adzer surfaces of the tie and the new or recycled tie plates are dropped onto the prepared ties by tie dropper 42 after which lining of the track, line spiking, gauging and gauge spiking are carried out.

Each of the various track working instruments does, of course, have means for operating simultaneously at the right and left rail locations. For example, the adzer comprises two adzer devices both mounted on a single frame and the crib sweeper comprises two spaced brushes mounted on the frame.

The pairs of devices at each work station are mounted on the respective frames at a distance apart corresponding to the track gauge and the frames are laterally movable conjointly in response to signals from a center line follower, which detects the track center line, so as to maintain the devices situated over the appropriate rail locations even on a curved section of track.

With particular regard to the adzer, an additional problem presents itself on curved track where the outside rail is elevated with respect to the inner rail. If no correcting action is taken, the tie plate beds cut by the two adzer devices on a particular tie will not be banked, i.e., both beds cut will be horizontal. Accordingly, the frame supporting the two adzer devices has to be capable of pivoting to provide for the superelevation condition at curves.

Figure 2:
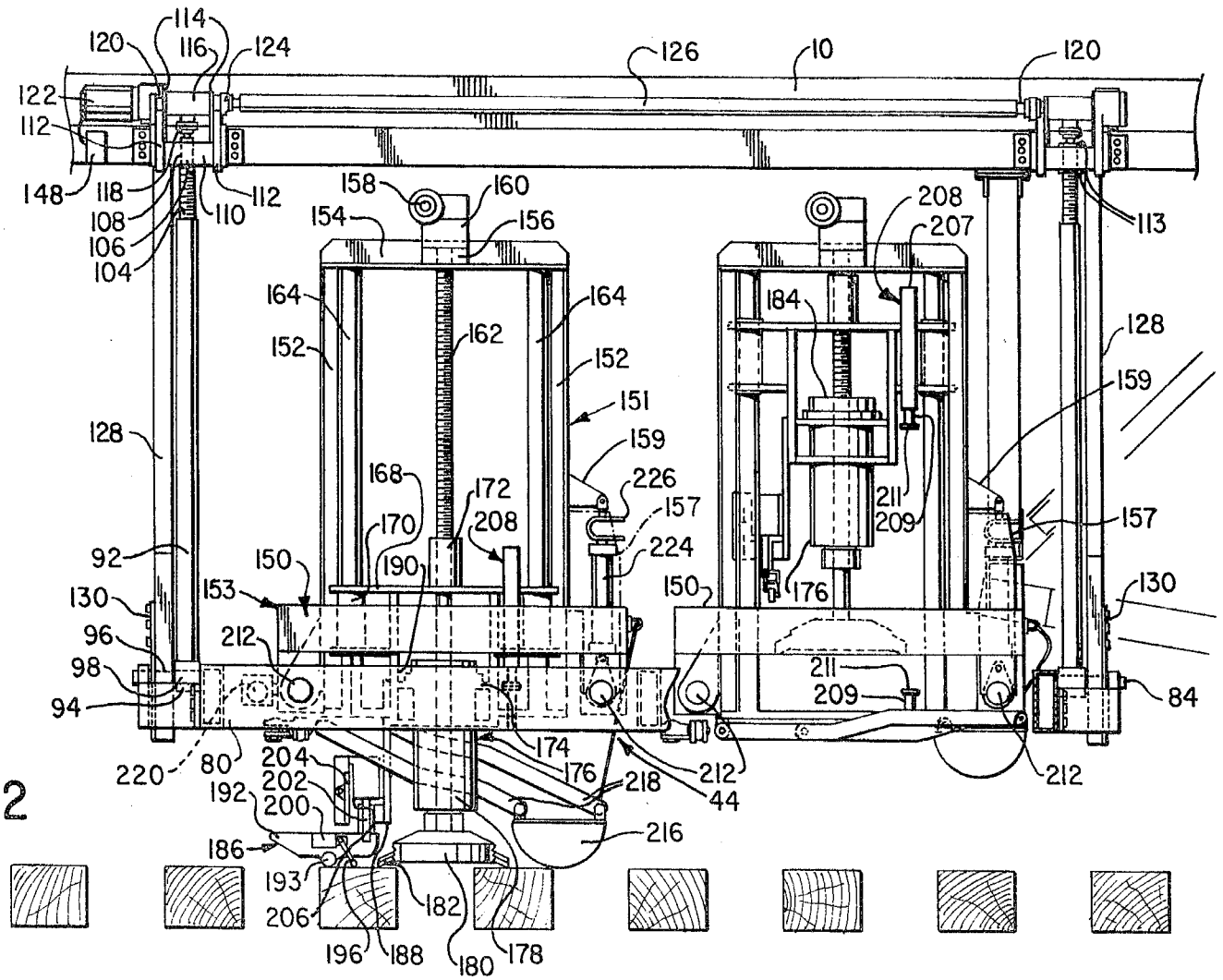
FIG. 2 is a side view to a large scale of the adzer portion of the rail changing machine shown in FIG. 1.
Figure 3:
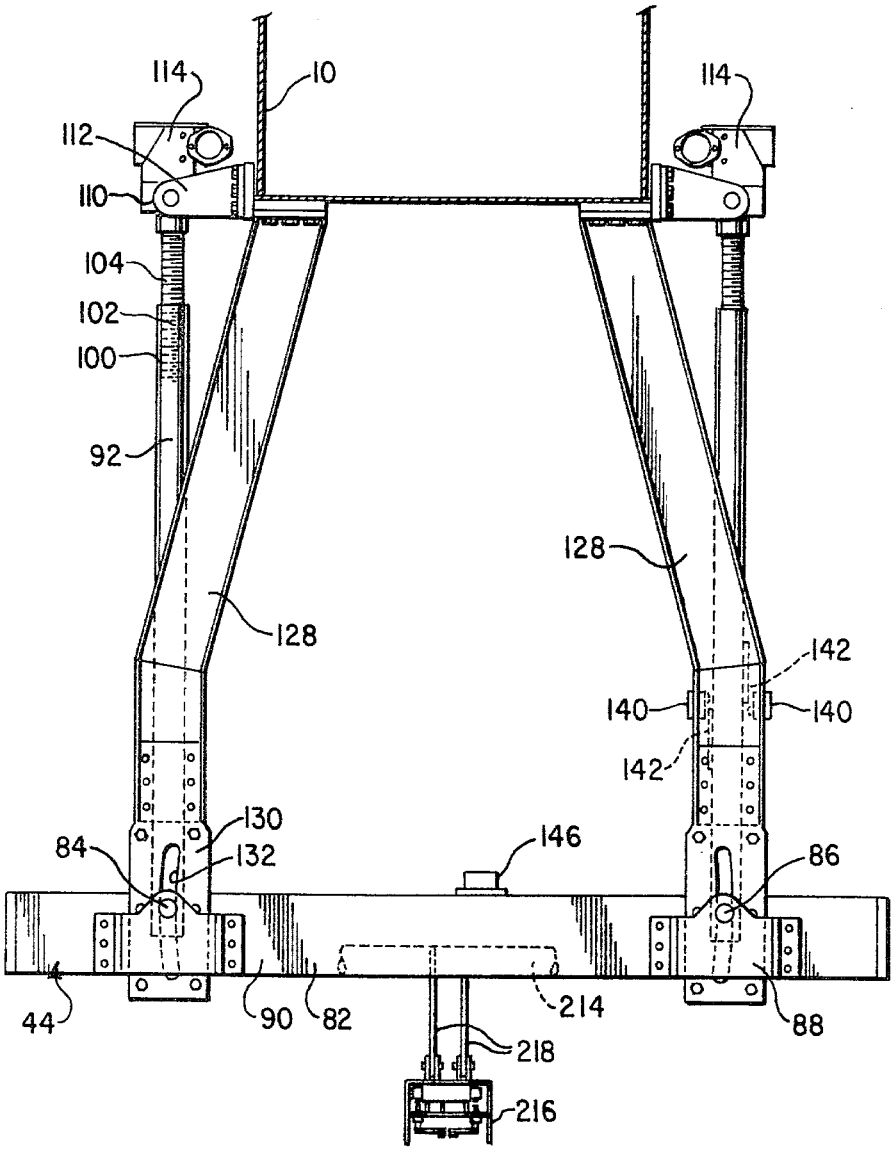
FIG. 3 is an end view of a pivotal frame forming part of the adzer arrangement shown in FIG. 2.

With reference to FIG. 2 and FIG. 3, the adzer frame 44 is rectangular comprising two longitudinal beams 80 welded to two cross beams 82. Each cross beam 82 carries two horizontal pin members 84 and 86 located an equal distance from the ends of the cross beam. The pins 84 and 86 of the forward beam 82 extend forwardly and the pins 84 and 86 of the rearward beam 82 extend rearwardly. A U-shaped bracket 88 is provided for each pin, the bracket being mounted to the same face 90 of the cross beam 82 as is the respective pin such that each pin 84 or 86 is supported at its ends between the beam 82 and the bracket 88.

The frame 44 is supported on the main frame or centre beam 10 of the machine by means of four rod and sleeve pairs located respectively at the positions of the four pins 84 and 86. Each rod and sleeve pair comprises a vertical sleeve member 92 having at its lower end a squared end configuration 94, the squared end 94 having a horizontal through hole 98 receiving the respective pin 84 or 86. The squared end 94 is situated between the face 90 of the crossbeam 82 and the respective bracket 88.

The upper end of each sleeve 92 is formed with an internal thread 100 which receives the lower end 102 of the externally threaded rod 104. The upper end 106 of rod 104 is received in a through hole 108 of a block 110 pivotably mounted between two brackets 112 bolted to the main frame 10, rod 104 being provided near end 106 with two collars 113 abutting block 110 and securing rod 104 at a fixed longitudinal location to block 110. Two further brackets 114 are mounted on the upper surface of block 110 and support between them a reduction gear box 116 having a vertical output shaft 118 directly coupled to the upper end of rod 104. The input shaft 120 of each gear box 116 is horizontal and the input shaft 120 of the forward gear box (i.e., the one shown on the left in FIG. 2) is driven by a hydraulic motor 122. The input shaft 120 of the rearward gear box is connected with a horizontal output shaft 124 of the forward gear box by means of a drive shaft 126.

Associated with each pin 84 or 86 is a guide member which comprises a beam 128 bolted at its upper end to the main frame 10 and having bolted to its lower surface end a guide plate 130. The guide plate has a through slot 132 dimensioned to receive the associated pin, the slot 132 being elongated generally vertically but being also gently curved symmetrically above and below a centre or null point which coincides, in FIG. 3, with the location of pin 84 or 86. The centre of curvature of each slot 132 coincides with the centre point of the slot 132 in the other guide plate 130 located at the same longitudinal position. It should be apparent that with the above described configuration, if the two sleeves 92 on one side of the frame, say the left side as seen in FIG. 3, are raised or lowered and the other two sleeves 92 maintained stationary, the frame 44 will pivot about the pins 86, the pins 84 being guided in the respective slots 132.

Because it is important that such pivoting be carried out when the stationary pins are located in the centre or null position of the respective slots in order that the other slots define the correct path for the moving pins, it is beneficial to provide means for sensing the null positions and disabling the drive circuit for the pivoting action until the null position is assured. The particular sensing means shown are two limit switches 140 mounted on one of the two right hand guide beams 128 and two identical limit switches 140 mounted on one of the two left hand guide beams 128. The limit switches each cooperate with a respective abutment 142 provided on the adjacent respective sleeve 92. The two abutments on each sleeve are so located relative to their respective limit switches that there is only one very small range of vertical travel over which both limit switches are in the same condition, e.g., closed in this embodiment, this small range corresponding to when the pin 84 or 86 is located at the centre point of the slot 120.

Mounted on the frame 44 is an inclinometer 146 know per se and shown only in diagrammatic form. The inclinometer is of the type which uses a free hanging pendulum to generate an analogue voltage corresponding to the angle of inclination. The inclinometer is mounted to sense the inclination of the frame 44 in the lateral direction and the output signal is fed to a microprocessor described below.

Each hydraulic motor 122 is controlled in forward and reverse senses by solenoid valves 148 mounted on the main frame 10 adjacent the motor 122 and the solenoid valves are controlled by the microprocessor.

Referring now to FIG. 2, a laterally movable frame 150 comprises two spaced vertical members 152 supporting a cross beam 154. A mounting bracket 156 on beam 156 carries a hydraulic motor 158 and a reduction gear box 160 the output side of which is connected to drive a threaded rod 162 disposed vertically and equispaced relative to members 152. Two vertical guide rods 164 disposed adjacent the members 152 are also connected top and bottom to frame 150.

A vertically movable carriage 168 has two spaced bushings 170 slidably received on respective guide rods 164 and a central, internally threaded bushing 172 through which rod 162 threadably extends.

Supported on a cross-member 174 of the carriage 168 is an adzer or cutter 176 comprising a body 178 rotatably supporting a cutter head 180 located at the bottom of the body. The head 180 has peripheral cutting blades 182 disposed with their tips in a horizontal plane or planes.

Mounted also on the carriage 168 is a motor (located behind the cutter body in FIG. 2 and hence not visible in that FIG.) connected to drive the cutter head 180 by a belt (not shown) wrapped around the uppermost member of the adzer 176 which is a rotatable head 184 connected to cutter head 180 by means of a shaft extending through the body 178.

Associated with adzer 176 is a depth sensor 186 which is mounted indirectly on a mounting plate 188 carried on plate portion 190 formed on the forward side of carriage 168. The sensor 186 is mounted directly in front of cutter head 180 in the longitudinal direction of travel of the rail changing machine and comprises a body 192 having a wheel 193 at its lowest point and an arm 196 trailing the wheel and pivotably mounted at one end on the body. The arm is arranged to assume normally a generally vertically downwards position either under the influence of gravity or spring bias as desired but is pivoted counterclockwise when engaged by a tie. A limit switch 200 is mounted on the body and closes by engagement with arm 196 a circuit to a potentiometer wiper or plunger 202 carried on body 192 after a pre-determined counterclockwise rotation. The potentiometer body 204 is mounted on plate 188 so that vertical movement of the body 192 changes the potentiometer 206 output.

Carried on the carriage 168 is the body of another potentiometer 208 carried on frame 150. Vertical movement of carriage 168 with respect to frame 150 changes the output of this other potentiometer accordingly. The outputs of the two potentiometer are compared in circuitry, to be discussed below in connection with FIG. 5, whereby an error signal is generated to drive motor 158 through solenoid valves 258 to move cutter head 180 to the correct height for cutting to a predetermined depth. This circuitry could be incorporated in the microprocessor to be described below.

The adzer frame 44 is, as explained above, mounted for selective pivoting relative to the main frame 10 and the adzer frame carries laterally movable frame 150 on which is supported the vertically movable carriage 168 and adzer 176. It should be appreciated that as there are two identical adzers, one adjacent each rail position, there are two identical frames 150 and carriages 168 laterally aligned. The frames 150 are slidably supported on laterally extending spaced guide rods 212 extending between the longitudinal beams 80 of pivotal frame 44. The two frames 150 are spaced apart laterally a predetermined amount by beam 214 (not seen in FIG. 2) which is adjustable for the gauge of the track and which carries at its mid-point a centre line follower 216 connected to the beam by means of two parallel pivotal links 218. A pneumatic cylinder 220 is mounted between one longitudinal beam 80 and one frame 150 for moving both frames conjointly right or left under the control of the centre line follower. Although two aligned adzers are sufficient, it has been found beneficial to provide a spare pair of adzers so that when it is necesssary to repair or replace the teeth of the working adzers, these are simply pulled up out of contact with the ties and the spare adzers wound down. FIG. 2 shows the spare adzers at the rear in the withdrawn or standing position.

Each frame 150 is, in fact pivotally mounted for pivoting movement in a vertical plane on forward rods 212 as well as being laterally slidable thereon. In order to accomplish both the lateral or transverse movement on front and rear guide rods 212, and the pivotal movement about front guide rods 212, each frame 150 comprises two sub-frame members 151 and 153. Sub-frame 151 comprises spaced vertical members 152 and top cross beam member 154; sub-frame 153 comprises lower horizontal, longitudinally extending beams 155 and right gusset plates 157, as seen in FIG. 2. The bearing member (not shown) which supports frame 150 on front guide rod 212 for lateral sliding movement and pivotal movement in a vertical plane is part of sub-frame 151. The bearing member (not shown) which supports frame 150 on rear guide rod 212 for lateral sliding and pivotal movement in a vertical plane is part of sub-frame 153. Thus sub-frame 151 is the pivotal portion of frame 150, and sub-frame 153 is constrained for only lateral movement. A pneumatic cylinder 224 is interconnected between sub-frame 153 and a U-member 226 which is attached to bracket 159 mounted to vertical beam 152 of sub-frame 151. A strain gauge (not shown) mounted on member 226 causes extension of cylinder 224 when the strain measured exceeds a predetermined amount. Thus, if the adzing head encounters high resistance, sub-frame 151 will tend to be forced in a counterclockwise direction and this will cause deflection of member 226 and the strain gauge causing extension of cylinder 224 and counterclockwise pivoting of sub-frame 151.

As explained above, the frame 44 is designed to pivot according to the superelevation of one rail relative to the other. Superelevation is measured using a conventional pendulum system operating a rotary potentiometer, as is known. Because this aspect of the machine is conventional and does not form part of the present invention it will not be described in detail. The conventional system, however, measures the superelevation of the actual rails and is not capable of measuring the degree of tilting or banking of the track (i.e., the ties) when the rails have been removed. This presents a problem when used with the present rail changing machine in that it is particularly concerned with the superelevation at locations on the track from which the old rails have been removed.

Figure 1B:
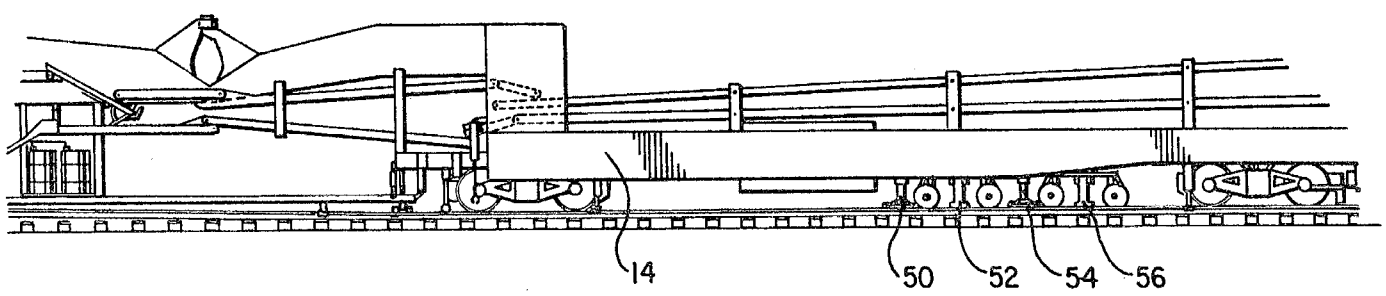
Figure 4:
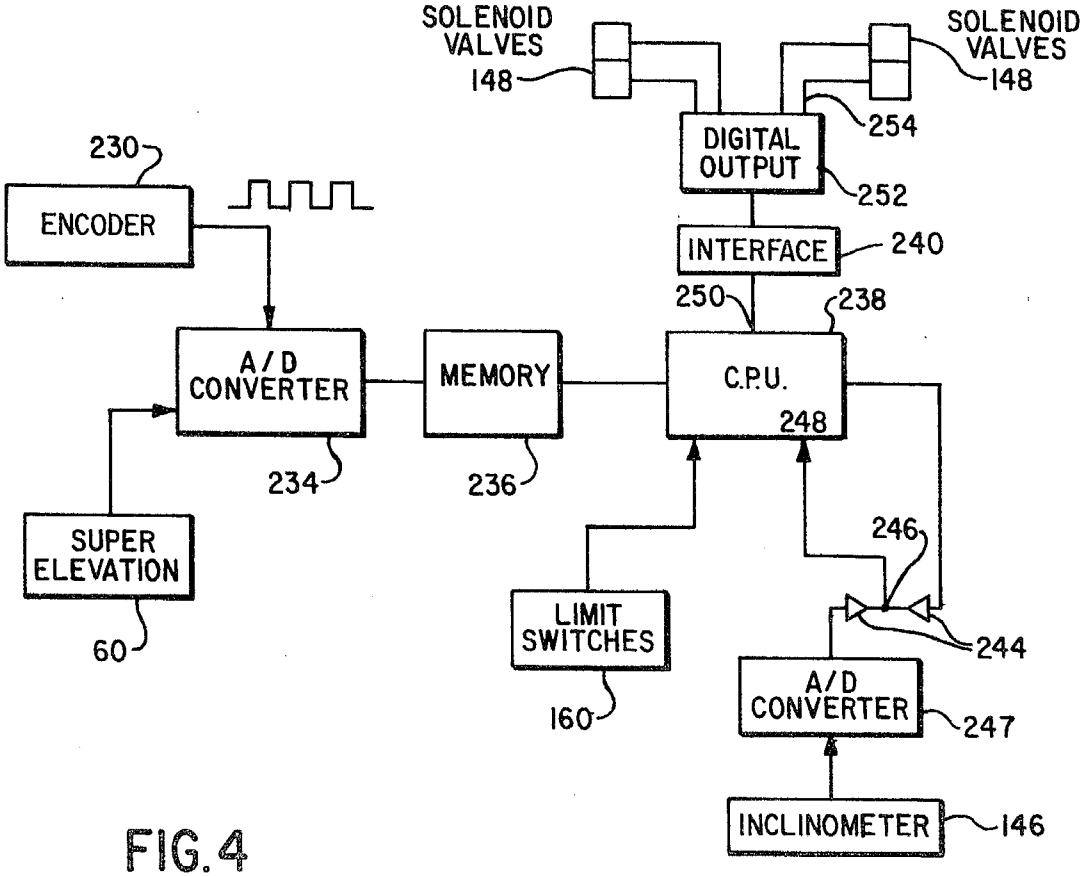
FIG. 4 is a block diagram of the microprocessor used in controlling the pivoting of the adzer.

Accordingly, the pendulum system 60 is mounted on bogie 232 (see FIG. 1) forward of the adzing station, and indeed, forward of the rollers 21 for picking up the old rails so that it is measuring continuously the superelevation with respect to two rails. In order that the readings obtained can be matched with the adzer location, the following arrangement is provided:

Reference is made to FIG. 4 for a description of the microprocessor for using the information from the superelevation measurements system 60, from the inclinometer 146, and from the limit switches 140 to control the operation of the solenoid valves 148 thus to control tilting of the adzer frame 44. An encoder or pulse generator 230 which is driven by track engaging wheel 61 located near a front bogie of the rail changing machine R (see FIG. 1) is used to clock an analogue/digital converter 234 which is supplied with analogue signals from superelevation system 60. The digital output from the converter 234 is fed to a memory 236 the output of which is fed to a central processing unit (C.P.U.) 238. CPU 238 can average a series of consecutive superelevation readings temporarily stored in memory 236 to provide a series of averaged values representing the superelevation of consecutive portions of the original track. In the particular system utilized, 52 readings are taken over an 18 inch distance which is the centerline to centerline distance between ties. These 52 readings are averaged and one value is stored in memory representing the superelevation at one tie. The geometry of the overall rail changing machine R is such that there is 63 feet between the superelevation measuring system 60 and the adzing station 40 and this distance represents 42 tie spacings. Thus 42 values are stored, the 42 values representing the cross levels at 42 consecutive ties. Of course, compensation must be made for which of the forward or rearward adzer is being used.

The inclinometer 146 mounted on adzer frame 66 has an output which is connected to an analogue/digital converter 242, and the output of that converter is compared with the values shifted out of memory 236, usually through the CPU 248, using two opposing diodes 244, the common point 246 of which is fed to an input 248 of CPU 238. This comparison of desired superelevation as previously read by measuring system 60 and the value obtained during adzing provides a closed loop control system.

The CPU 238 has an output 250 upon which appears the error signal at point 246, again typically passed through the CPU 238. This output is passed through interface circuit 240 to digital output device 252 which produces the operating voltage for solenoid valves 148. The signal from CPU 238 is dependent upon the polarity of the signal derived at point 246 after comparing the outputs of the diodes 244. Thus, an output signal appears on one of the four outputs 254 of digital output 252 to operate a specific one of the four solenoid valves 148 to cause rotation in the correct direction of associated hydraulic motor 122 to achieve correct tilting of frame 44. When the correct tilt is achieved the signal from inclinometer 146 will equal that from memory 236 and the motor 122 is ordered to stop.

The CPU 238 also has an input from the limit switches 160, and the CPU is programmed to prevent ordering of rotation about a specific pin unless and until that pin is in the null position. If, in fact, that pin is not in a null position, this is apparent from the signals supplied by the limit switches 160 to CPU 238 and the CPU is programmed to cause device 252 to energize that solenoid valve which will cause the pin to return to the null position. Thereafter, the CPU will order the tilting sequence.

The overall operation of the adzer arrangement according to the invention will now be described. As the machine progresses along the track, the superelevation device 60 via the microprocessor is supplying electrical signals to the solenoid valves 148 causing the frame 44 to pivot about the required pin 84 or 86 so as to maintain the two laterally displaced cutting heads in the same plane even on superelevated track. This is accomplished because the pivot point is essentially at the same point (just slightly above the grade rail) which is the point from which the superelevation is measured. This feature eliminates the need to change the depth of cut with change in superelevation as, for example, would be necessary if the adzer frame 44 had been pivoted about its lateral center.

Simultaneously, the center line follower 216 is causing the frame 44 to track to right or left to maintain the cutting heads the correct lateral distance from the center line.

Simultaneously, the sensors 186 are running along the track and as each one runs over the surface of a tie it drops under gravity into the lowest part of the tie disposed in its path. A voltage is derived on foot potentiometer 206 indicating the height of this low point which would normally be the bed cut into the tie for the former tie plate. However, the circuit to the potentiometer is not closed until the limit switch 200 is actuated by arm 196 engaging the tie which ensures that the sensor is actually in engagement with the tie. The output voltage obtained is compared with that from potentiometer 208 and the error signal obtained used to drive hydraulic motor 158 so as to raise or lower the appropriate cutting head in a direction to cancel the error signal. The body 207 of potentiometer 208 is mounted on vertically movable carriage 168, and the plunger or wiper arm is attached to frame 150. Because the carriage 168 must be moved upward a considerable distance for road travel and for replacement of the cutting blades 182, plunger member 209 of potentiometer 208 is caused to separate and is joined by magnetic coupling member 211 when carriage 168 is moved into working position. Thus as the cutting heads reach each tie they are automatically adjusted to impinge at right angles to the tie upper surface, they are automatically adjusted to the correct lateral location and they are automatically adjusted to the correct cutting depth.

One complication arises from the potentiometer arrangement shown. Because the potentiometer 206 is mounted for movement with the adzer head, as the cutting head is moved in a direction to remove the error signal, the potentiometer 206 is returned to its original null position but the potentiometer 208 is continuously changing with movement of carriage 168. Thus, it is necessary to provide a correction in the potentiometer circuit to bring the null point of potentiometer 208 back to its original value. This entire circuitry, of course, can be incorporated in the microprocessor of FIG. 4. However, it may be more convenient to maintain this circuit independent.

Figure 5:
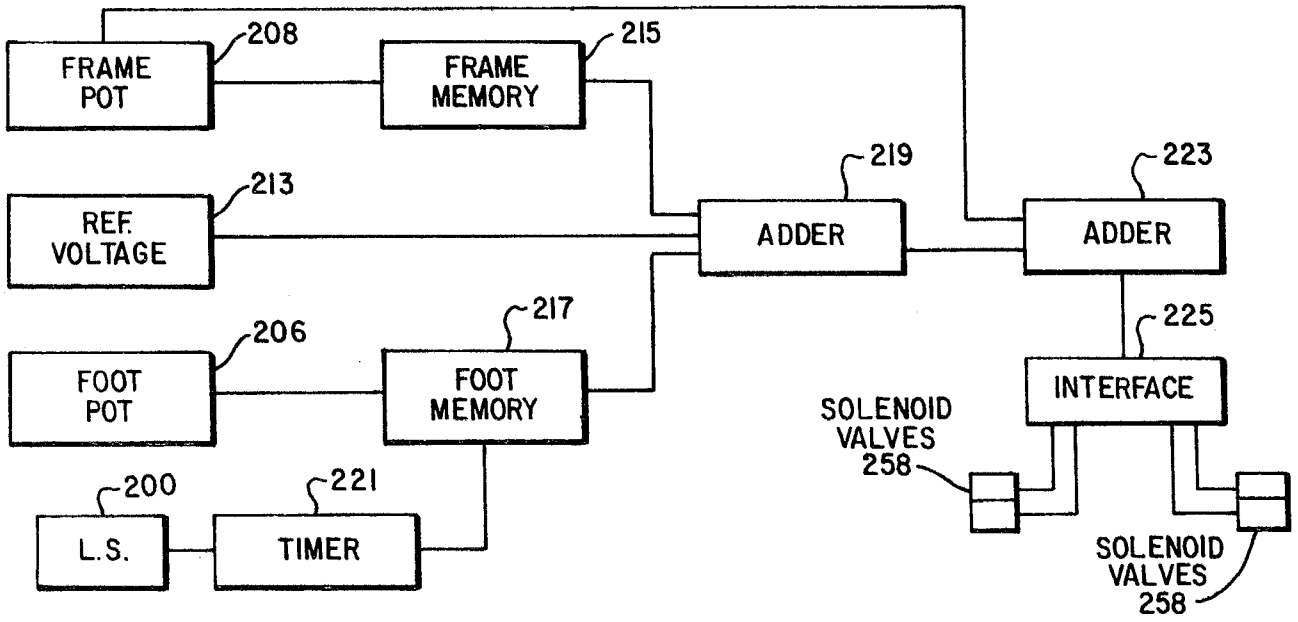
FIG. 5 is a block diagram of the adzer depth control circuit.

Referring to FIG. 5, a block diagram is shown of an adzer depth control circuit which is independent of the microprocessor circuit of FIG. 4. The purpose of this circuit is to utilize the signal from foot potentiometer 206 which represents the location of the top of a tie to be worked with respect to the adzer workhead (i.e., the cutting edges of blades 182) and the signal from potentiometer frame 208 which represents the location of the adzer workhead with respect to frame 150 to calculate an error signal which represents the difference in elevation between a tie that is about to be worked and the previous tie worked. The adzer frame is then moved to reduce this error signal to zero, moving the cutting head into the proper position for the next tie. The system is adjustable to remove a predetermined amount from the measured top of the tie which usually is of the order of ⅛". When wheel 193 of depth sensor foot 186 is in the same plane as the cutting edges of adzer cutting blades 182, there will be some voltage across foot potentiometer 206. A voltage equal in value but opposite in polarity is set by reference voltage device 213.

As previously mentioned, the depth sensing circuit is actuated by closure of limit switch 200 which assures that wheel 193 of depth sensor 186 is on a tie surface. This sample and hold circuit comprising frame (position) memory 215 and foot (position) memory 217 is sampled for approximately 0.1 seconds as determined by timer 221 and adder or summing amplifier 219 adds the frame position from memory 215 and the foot position from memory 217 plus the reference value to produce an output which represents the present location of the workhead ± the deviation of the next tie. The output from adder 219 is then fed to adder or summing amplifier 223 along with the previous level value from the frame potentiometer 208 to produce an error signal which is fed to interface circuit 225 to produce an output signal on one of the four outputs 227 to actuate the specific one of the four solenoid valves 258 to cause rotation in the proper direction of associated hydraulic motor 158 to move the adzer head up or down to reduce the error to zero and properly position the adzer head for the correct depth of cut on the next tie.

The embodiments of the invention in which an exclusive property or privilege is claimed are defined as follows:

1. A machine for adzing at two laterally spaced locations corresponding to the desired locations of new rails, the upper surfaces of wooden ties of a railway track from which old rails and tie plates have been removed, the machine comprising a main frame having a forward end mounted on first rail engaging means adapted to run on the old rails and a rearward end mounted on second rail engaging means adapted to run on the new rails, a pivotal frame carried on the main frame at a position between and remote from the first and second rail engaging means, two adzers mounted at two laterally spaced locations on the pivotal frame, and means for pivoting the pivotal frame selectively about approximately one adzer location or approximately the other adzer location, whereby both adzers can be positioned substantially perpendicular to the ties even on superelevated track.

2. A machine according to claim 1 further comprising means for measuring the superelevation of the track and deriving an electrical signal indicative of the superelevation and control means for controlling the means for pivoting the pivotal frame in response to the superelevation measured whereby the frame is automatically pivoted to the correct inclination.

3. A machine according to claim 2 in which the means for measuring the superelevation of the track is disposed ahead of the adzer locations and said machine further comprises means for storing measured values of superelevation and means for reading out the stored values to the control means in correspondence with advancement of the adzers whereby the superelevation values correspond to the adzer locations in the longitudinal direction of the track.

4. A machine according to claim 1 in which the pivotal frame is pivotally mounted by pivot pins on lower portions of at least two support members at respective lateral locations corresponding to the adzer locations, the support members being pivotally connected at their upper ends to the main frame of the machine, and further comprising means for raising and lowering each support member selectively and guide means constraining the pivotal frame to move in respective arcs about the pivot pins at the lower portions of the support members.

5. A machine according to claim 4 in which the guide means comprises at least one guide member mounted rigidly on the main frame of the machine and having a generally vertical through slot receiving one of the pivot pairs, the slot being arcuate about a radius of curvature coinciding with the other pin, whereby the one pin is constrained to move in the slot.

6. A machine according to claim 4 in which the guide means comprises at least two guide members mounted rigidly on the main frame of the machine and each having a generally vertical through slot receiving a respective one of the pivot pins, each slot being arcuate about a radius of curvature coinciding with the other one of the pivot pins, whereby each pin is constrained to move in the respective slot.

7. A machine according to claim 1, in which the pivotal frame is pivotally mounted by two pairs of pivot pins on lower portions of two pairs of support members each pair being provided at a respective lateral location corresponding to a respective adzer location, the support members being pivotally connected at their upper ends to the main frame of the machine, and comprising means for raising and lowering each pair of support members selectively and guide means constraining the pivotal frame to move in respective arcs about the pivot pins at the lower portions of the support members.

8. A machine according to claim 7 in which the guide means comprises two pairs of guide members mounted rigidly on the main frame of the machine and each guide member having a generally vertical through slot, the slots of each pair being provided at a respective lateral location and receiving respective ones of the pivot pins, the slots of each pair being arcuate about a radius of curvature coinciding with the other pivot pins, whereby both pairs of pivot pins are constrained to move in the respective slots.

9. A machine according to claim 8 in which each support member comprises a sleeve connected to a respective one of the pivot pins and having an internally threaded upper end, and an externally threaded rod threadably received on the sleeve and the means for raising and lowering each pair of support members comprises a motor drivingly engaged with the externally threaded rods.

10. A machine according to claim 9, further comprising means for measuring the superelevation of the track and control means for controlling the direction and amount of rotation of the motors in response to the superelevation measured whereby the frame is pivoted to the correct inclination.

11. A machine according to claim 10, further comprising an inclinometer carried on the pivotal frame and deriving an electrical signal indicative of the lateral inclination of the frame and circuit means comprising the electrical signals derived by the superelevation means and the inclinometer and energizing the control means according to any difference between these electrical signals.

12. A machine according to claim 11 in which the motors are hydraulic motors and the control means comprise solenoid valves.

13. A machine according to claim 10, in which the means for measuring the superelevation of the track is disposed ahead of the adzer and said machine further comprises means for storing successive values of superelevation measured, counting means deriving a count indicative of the distance travelled by the machine, means for reading out of the storing means to the control means the superelevation values under control of the counting means such that the value read out at any time corresponds to the longitudinal location of the adzer.

14. A machine according to claim 13 comprising an inclinometer carried on the pivotal frame and deriving an electrical signal indicative of the lateral inclination of the pivotal frame and circuit means comparing the electrical signals derived from the store and the inclinometer and energizing the control means according to any difference between these electrical signals.

15. A machine according to claim 14 in which the motors are hydraulic motors and the controls means comprise solenoid valves.

16. A machine according to claim 8 further comprising means on each pair of support members sensing when the pivot pins attached to the lower ends of the support members are disposed in the centre or null position of the associated slots and means associated with each sensing means disabling the means for raising and lowering a specific pair of support members unless the other pair of support members has its pivot pins in the null position.

17. A machine according to claim 16 in which each sensing means comprises limit switch means and limit switch actuator means mounted one on a support member and one on a guide member.

18. A machine according to claim 1 in which each adzer is mounted on the frame for movement perpendicular to the transverse line joining the two adzer locations and further comprising means for moving the adzers perpendicular to that line to a lowered position whereby they can adze the tie surfaces to a predetermined depth.

19. A machine according to claim 18 in which independent means is provided for moving each adzer and including height sensing means attached to each adzer and engageable with the ties for sensing the height of the respective adzer from a tie, and circuit means for controlling the independent moving means in response to the measured height.

20. A machine according to claim 19 in which the height sensing means carries a wiper of a first potentiometer which derives a first voltage indicative of the distance travelled by the sensor to engage a tie and in which the adzer carries a wiper of a second potentiometer which derives a second voltage indicative of the adzer height and including means for comparing the first and second voltages and driving the independent moving means to achieve parity between the first and second voltages.

21. A machine according to claim 7 in which each adzer is mounted on the frame for movement perpendicular to the transverse line joining the two adzer locations and further comprising means for moving the adzers perpendicular to that line to a lowered position whereby they can adze the tie surfaces to a predetermined depth.

22. A machine according to claim 8 in which each adzer is mounted on the frame for movement perpendicular to the transverse line joining the two adzer locations and further comprising means for moving the adzers perpendicular to that line to a lowered position whereby they can adze the tie surfaces to a predetermined depth.

23. A machine according to claim 10 in which each adzer is mounted on the frame for movement perpendicular to the transverse line joining the two adzer locations and further comprising means for moving the adzers perpendicular to that line to a lowered position whereby they can adze the tie surfaces to a predetermined depth.

24. A machine according to claim 1 in which the two adzers are mounted on the pivotal frame for conjoint transverse movement and including a centre line follower adapted to sense the centre line of the track and derive an electrical output signal indicative of the position of the centre line relative to the lateral positions of the adzers and means for moving the adzers transversely in response to the electrical signal to locate the adzers at equal lateral distances from the centre line.

25. A machine according to claim 7 in which the two adzers are mounted on the pivotal frame for conjoint transverse movement and including a centre line follower adapted to sense the centre line of the track and derive an electrical output signal indicative of the position of the centre line relative to the lateral positions of the adzers and means for moving the adzers transversely in response to the electrical signal to locate the adzers at equal lateral distances from the centre line.

26. A machine according to claim 8 in which the two adzers are mounted on the pivotal frame for conjoint transverse movement and including a centre line follower adapted to sense the centre line of the track and derive an electrical output signal indicative of the position of the centre line relative to the lateral positions of the adzers and means for moving the adzers transversely in response to the electrical signal to locate the adzers at equal lateral distances from the centre line.

27. A machine according to claim 10 in which the two adzers are mounted on the pivotal frame for conjoint transverse movement and including a centre line follower adapted to sense the centre line of the track and derive an electrical output signal indicative of the position of the centre line relative to the lateral positions of the adzers and means for moving the adzers transversely in response to the electrical signal to locate the adzers at equal lateral distances from the centre line.

28. A machine according to claim 18 in which the two adzers are mounted on the pivotal frame for conjoint transverse movement and including a centre line follower adapted to sense the centre line of the track and derive an electrical output signal indicative of the position of the centre line relative to the lateral positions of the adzers and means for moving the adzers transversely in response to the electrical signal to locate the adzers at equal lateral distances from the centre line.

29. A machine according to claim 19 in which the two adzers are mounted on the pivotal frame for conjoint transverse movement and including a centre line follower adapted to sense the centre line of the track and derive an electrical output signal indicative of the position of the centre line relative to the lateral positions of the adzers and means for moving the adzers transversely in response to the electrical signal to locate the adzers at equal lateral distances from the centre line.

30. A machine according to claim 1 in which each adzer is mounted for pivoting upwardly about a lateral axis and including means operable to pivot the adzers upwardly and load measuring means measuring the load on the adzers in operation and connected to the operable means to cause pivoting of the adzers upwardly when the measured load exceeds a predetermined value.

31. A machine having means for removing old rails from a track, lifting the tie plates, preparing the existing wooden ties and relaying tie plates and new rails on the prepared wooden ties, the machine having an adzing station for adzing upper surfaces of the ties at two laterally spaced locations corresponding to the desired locations of the new rails, the adzing station comprising a main frame having a forward end mounted on first rail engaging means adapted to run on the old rails and a rearward end mounted on second rail engaging means adapted to run on the new rails, a pivotal frame carried on the main frame at a position between and remote from the first and second rail engaging means, two adzers mounted at two laterally spaced locations on the pivotal frame, and means for pivoting the pivotal frame selectively about approximately one adzer location or approximately the other adzer location, whereby both adzers can be positioned substantially perpendicular to the ties even on superelevated track.

32. A machine according to claim 31 in which the two adzers are mounted on the pivotal frame for conjoint transverse movement and including a centre line follower adapted to sense the centre line of the track and derive an electrical output signal indicative of the position of the centre line relative to the lateral positions of the adzers and means for moving the adzers transversely in response to the electrical signal to locate the adzers at equal lateral distances from the centre line.

33. A machine according to claim 32 in which each adzer is mounted on the frame for movement perpendicular to the transverse line joining the two adzer locations and further comprising means for moving the adzers perpendicular to that line to a lowered position whereby they can adze the tie surfaces to a predetermined depth.

34. A method of adzing upper surfaces of wooden ties of a railway track from which rails and tie plates have been removed at two laterally spaced locations for reception of replacement tie plates and rails using a machine according to claim 1, in which the superelevation of the track is measured ahead of the adzing machine before the rails are removed and the superelevation values obtained are stored until the machine reaches the corresponding positions on the track at which the pivotal frame is pivoted by amounts corresponding to the respective superelevation values.

35. A machine for adzing at two laterally spaced locations corresponding to the desired locations of new rails, the upper surfaces of wooden ties of a railroad track from which rails and tie plates have been removed, the machine comprising a frame, two adzers mounted at two laterally spaced locations on said frame, independent means for moving each adzer vertically, height sensing means attached to said frame forward of each adzer and engageable with the ties for sensing the height of the respective adzer from a tie, and circuit means for controlling independent moving means in response to the meausured height.

* * * * *